US007244019B2

(12) United States Patent
Watanabe

(10) Patent No.: US 7,244,019 B2
(45) Date of Patent: Jul. 17, 2007

(54) INK JET RECORDING APPARATUS

(75) Inventor: Shigeru Watanabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/331,383

(22) Filed: Jan. 13, 2006

(65) Prior Publication Data

US 2006/0114299 A1 Jun. 1, 2006

Related U.S. Application Data

(63) Continuation of application No. 10/703,685, filed on Nov. 7, 2003, now Pat. No. 7,011,398.

(30) Foreign Application Priority Data

Nov. 14, 2002 (JP) ..... 2002-330417

(51) Int. Cl.
*B41J 2/175* (2006.01)

(52) U.S. Cl. ..... 347/86

(58) Field of Classification Search ..... 347/7, 347/9, 85–87
See application file for complete search history.

(56) References Cited

U.S. PATENT DOCUMENTS 6,183,077 B1 2/2001 Hmelar et al.
6,702,427 B2 3/2004 Shimizu et al.

*Primary Examiner*—K. Feggins
(74) *Attorney, Agent, or Firm*—Morgan & Finngan LLP

(57) ABSTRACT

An ink jet recording apparatus for recording by discharging an ink onto a recording medium to be recorded, has a first ink tank for containing a first ink, a second ink tank for containing a second ink different from the first ink, and a holder enabling the ink tanks to be loaded therein. The ink tanks are provided with distinguishing members so that the holder is, though capable of being loaded with both of these two types ink tanks in a state before loading the ink tanks into the holder, loaded with one of the ink tanks with the result that the other ink tank becomes unable to be loaded into the holder. The holder is provided with a changeover mechanism corresponding to the distinguishing members of the ink tanks.

3 Claims, 8 Drawing Sheets

INK JET RECORDING APPARATUS

This application is a continuation application of U.S. application Ser. No. 10/703,685, filed Nov. 7, 2003 now U.S. Pat No. 7,011,398, and entitled "Ink Jet Recording Apparatus." Aforementioned U.S. application Ser. No. 10/703,685, filed Nov. 7, 2003, is incorporated by reference herein in its entirety.

This application claims the right of priority under 35 U.S.C. § 119 to Japanese Application Number 2002-330417 filed Nov. 14, 2002, in Japan

BACKGROUND OF THE INVENTION

1. Field of the Invention

The present invention relates to ink tanks for reserving inks supplied for a recording means, an ink tank holder loaded with the ink tanks and an ink jet recording apparatus including the ink tank holder.

2. Related Background Art

Dye inks have hitherto been mainly used in an ink jet recording apparatus for recording by discharging ink droplets. In terms of a light resistance, a gas resistance, etc., however, an importance of pigment inks is recognized, and the pigment inks come to be utilized for special colors (especially black).

Images recorded by the ink jet recording apparatus have been, however, visualized with a high quality over the recent years, wherein applications demanded of the ink jet recording apparatus have come to extend to fields requiring the light resistance and the gas resistance such as for outputting posters, photo images and so forth. In response to these demands, progresses in development of the ink jet recording apparatus utilizing the pigment inks for all the colors, have been seen in recent years.

The pigment inks still, however, have some inferiority to the dye inks in terms of a density, a color property, etc., and each of manufacturing companies manufactures the ink jet recording apparatuses using the dye inks and the ink jet recording apparatus using the pigment inks, respectively.

It is, however, large of demerit in cost from a viewpoint of a maker side that manages stocks to manufacture the ink jet recording apparatus having an ink tank holder for an exclusive use of the dye inks or an ink tank holder for the exclusive use of the pigment inks. In particular, an expansion of a market scale of the ink jet recording apparatuses for the exclusive use of outputting the posters and photo images, is underway, and an increase level thereof does not become so large, wherein the number of shipments is not yet stabilized. Therefore, the stock management is hard to handle, and there is a necessity of having a comparatively large quantity of stocks. Further, even the normal types of ink jet recording apparatuses for mass-selling decrease in their life-time as products nowadays, and the stock management is also hard to handle. Hence, a problem is that if there are a large quantity of stocks, there must be a large number of stocks to be disposed of. Moreover, it is preferable in terms of an environmental aspect under strict regulations in recent years to decrease the number of stocks to be disposed of because of giving a less damage to the environment.

Further, a recording apparatus serving for both of the pigment and the dye can also developed as other countermeasure, however, this scheme is not practical because of raising a cost for the main body and upsizing the main body as well.

SUMMARY OF THE INVENTION

It is an object of the present invention to provide an ink jet recording apparatus usable for dye inks and for pigment inks to customers in a way that changes over a dye and a pigment while reducing a risk of an inventory cost without unnecessarily raising costs for a main body and minimizing a damage to the environment that is caused by disposing of stocks.

To accomplish the above object, according to the present invention, an ink jet recording apparatus for recording by discharging an ink onto a recording medium to be recorded, includes a holder for accommodating ink tanks, wherein the ink tanks are provided with distinctions so that the holder is, though capable of being loaded with both of a dye ink containing ink tank and a pigment ink containing ink tank in a state before loading the ink tanks, loaded once with the ink tank with the result that only the loaded ink tank can be set in, and the holder is provided with a changeover mechanism corresponding to the distinctions of the ink tanks.

Furthermore, the distinctions of the ink tanks are attained by recessed/protruded members provided in positions different depending on the classifications of the inks to be contained in the ink tanks. Moreover, color distinctions in the recessed/protruded members are made by combinations of a plurality of recesses and protrusions. The recesses and the protrusions take the same configurations for the dye and the pigment each assuming the same color, and the distinction between the dye and the pigment is attained by having respective unique recessed members that do not depend on the ink colors.

As described above, according to the present invention, both of the dye ink tank and the pigment ink tank can be loaded into one ink tank holder, thereby making it possible to reduce a demerit in cost due to the inventory risk. It is also possible to reduce the damage to the environment that is caused by disposing of the stocks. Moreover, the protruded ribs which have once been fixed are released, whereby either the ink jet recording apparatus for the dye or the ink jet recording apparatus for the pigment becomes again usable to the customer. Hence, this implies the same as the two types of ink jet recording apparatuses are provided, and there does not arise such a problem that a load coming from desiring to integrating the two types of ink jet recording apparatuses, is not given to the customer in terms of the cost and the service as well.

BRIEF DESCRIPTION OF THE DRAWINGS

FIG. 6A showing a state of the tank socket before loading the ink tank; FIG. 6B showing a state when a pigment ink tank is loaded; and FIG. 6C showing a state when a dye ink tank is loaded;

FIG. 8A showing a state before loading the ink tank; and FIG. 8B showing a state of releasing the ink tank after the pigment ink tank has been loaded.

DESCRIPTION OF THE PREFERRED EMBODIMENTS

An embodiment of the present invention will hereinafter be described with reference to the accompanying drawings.

Herein, to begin with, a whole configuration of a recording apparatus will be discussed, next an ink tank will be explained, and a holder corresponding to this ink tank will be described.

(Whole Configuration of Apparatus)

Figure 1:
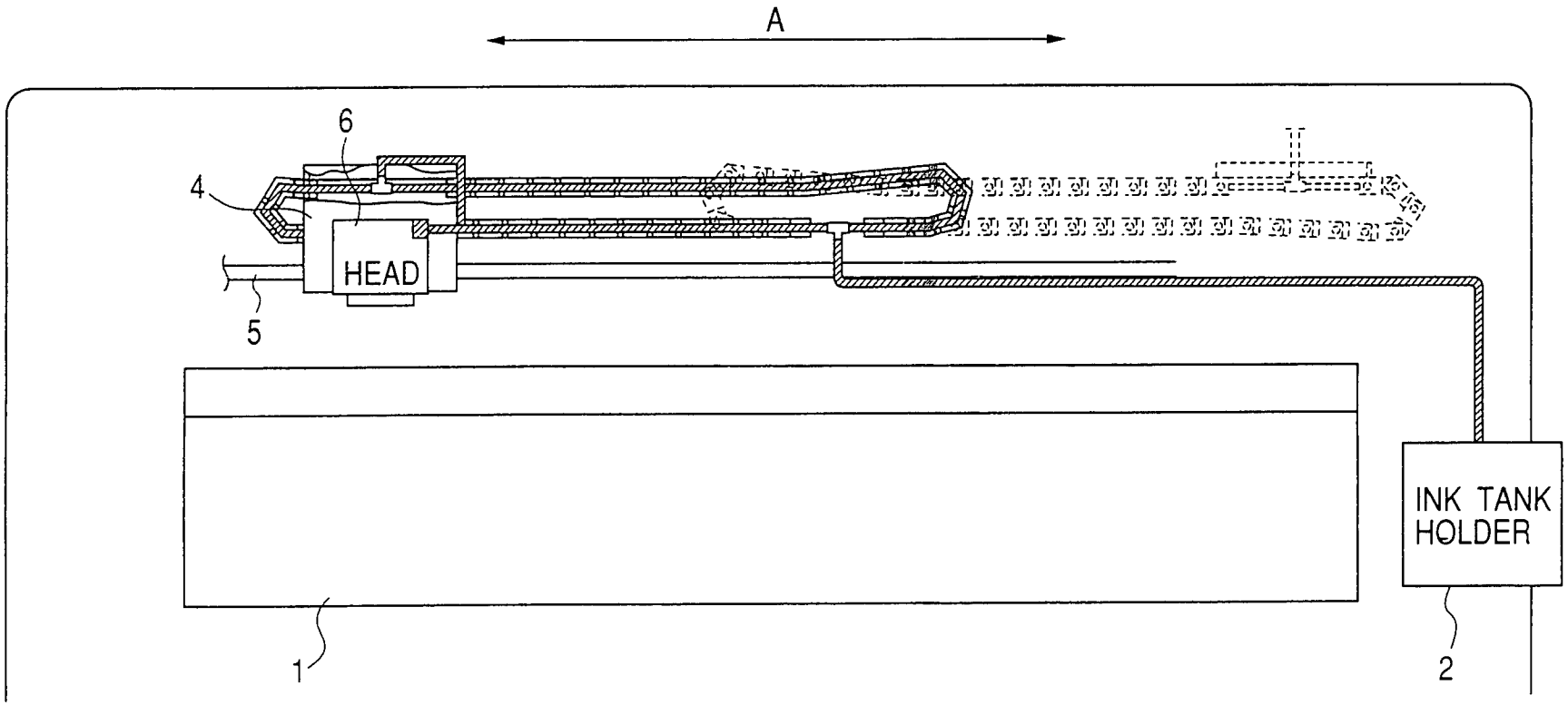
FIG. 1 is a front view of an ink jet recording apparatus according to the present invention.

FIG. 1 is a schematic front view of an ink jet recording apparatus according to the present invention, wherein the illustration concentrates particularly on a periphery of a head and an ink supply route as well.

The illustrated ink jet recording apparatus has, as shown in FIG. 1, such a configuration that an ink tank (see FIG. 2) is attached to an ink tank holder 2, the ink tank and a carriage 4 are connected to each other via a tube, and then inks are supplied to the head through the tube.

A recording medium accommodated in a recording medium accommodation unit 1 is conveyed onto a platen by a feed roller that is driven to rotate. Thereafter, the recording medium is sucked to the platen by a suction fan and pressed against a conveying roller by a pinch roller. Thereafter, a position and a width (size) of the recording medium are read by an unillustrated reflex optical sensor fitted to the carriage 4, and a predetermined record is conducted by a recording means. Then, after being recorded, the recording medium is discharged and thereafter cut off by an unillustrated cutter. A recording means records an image on the recording medium conveyed along on the platen. The recording means in the present embodiment, however, involves the use of a serial type ink jet recording system, wherein the carriage 4 is held slidably by a guide shaft 5 in a position facing the platen so that the carriage 4 is movable in reciprocation in A-directions in FIG. 1. A timing belt is looped around a pulley driven by an unillustrated carriage motor is secured to this carriage 4, whereby the carriage motor is driven in accordance with a recording operation and causes reciprocating movements of the carriage 4 in main scan directions.

A recording head 6 is detachably attached to the carriage 4. The recording head 6 is provided so that its ink discharge port faces the platen, and serves to record the image on the recording medium in a way that discharges a liquid ink out of the discharge port by transmitting a recording signal to the recording head 6, corresponding to the movement of the carriage 4.

Note that the present embodiment takes an ink discharge system, wherein an electrothermic converting element is electrified corresponding to the recording signal, and the ink is discharged from the discharge port by dint of a growth and shrinkage of bubbles produced in the ink in a way that makes use of film boiling occurred in the ink due to a thermal energy thereof, thus effecting the record.

(Ink Tank)

Figure 2:
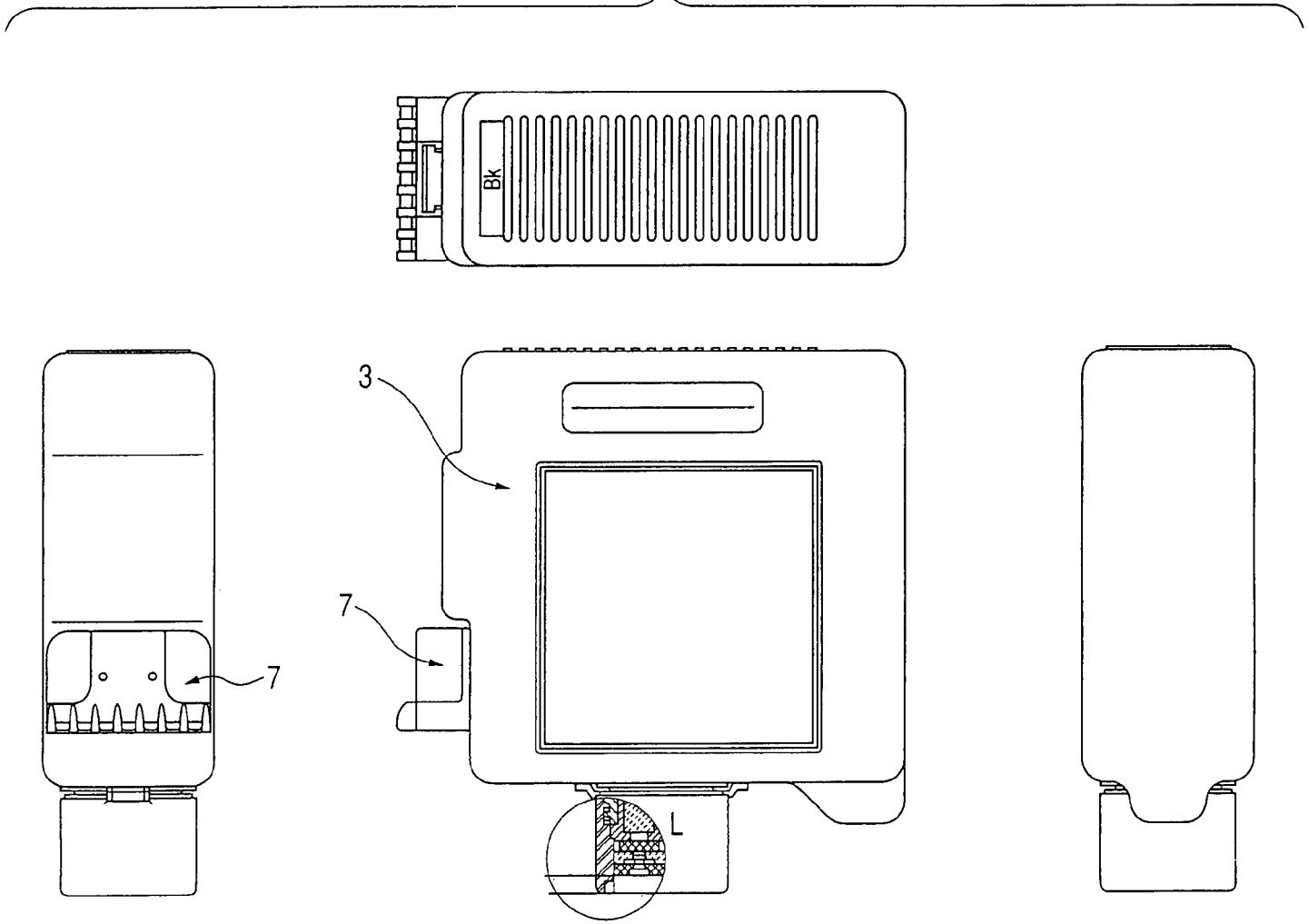
FIG. 2 is a view showing three surface of an ink tank.

FIG. 2 represents a view of three surfaces of the ink tank.

The ink tank 3 has a recessed/protruded portion 7 for distinguishing between color classifications and between a dye and a pigment. The recessed/protruded portion 7 is constructed of seven pieces of cuttable pawls, wherein a predetermine pawl member is cut away, hereby distinguishing between the respective colors and between the dye ink and the pigment ink.

Figure 3:
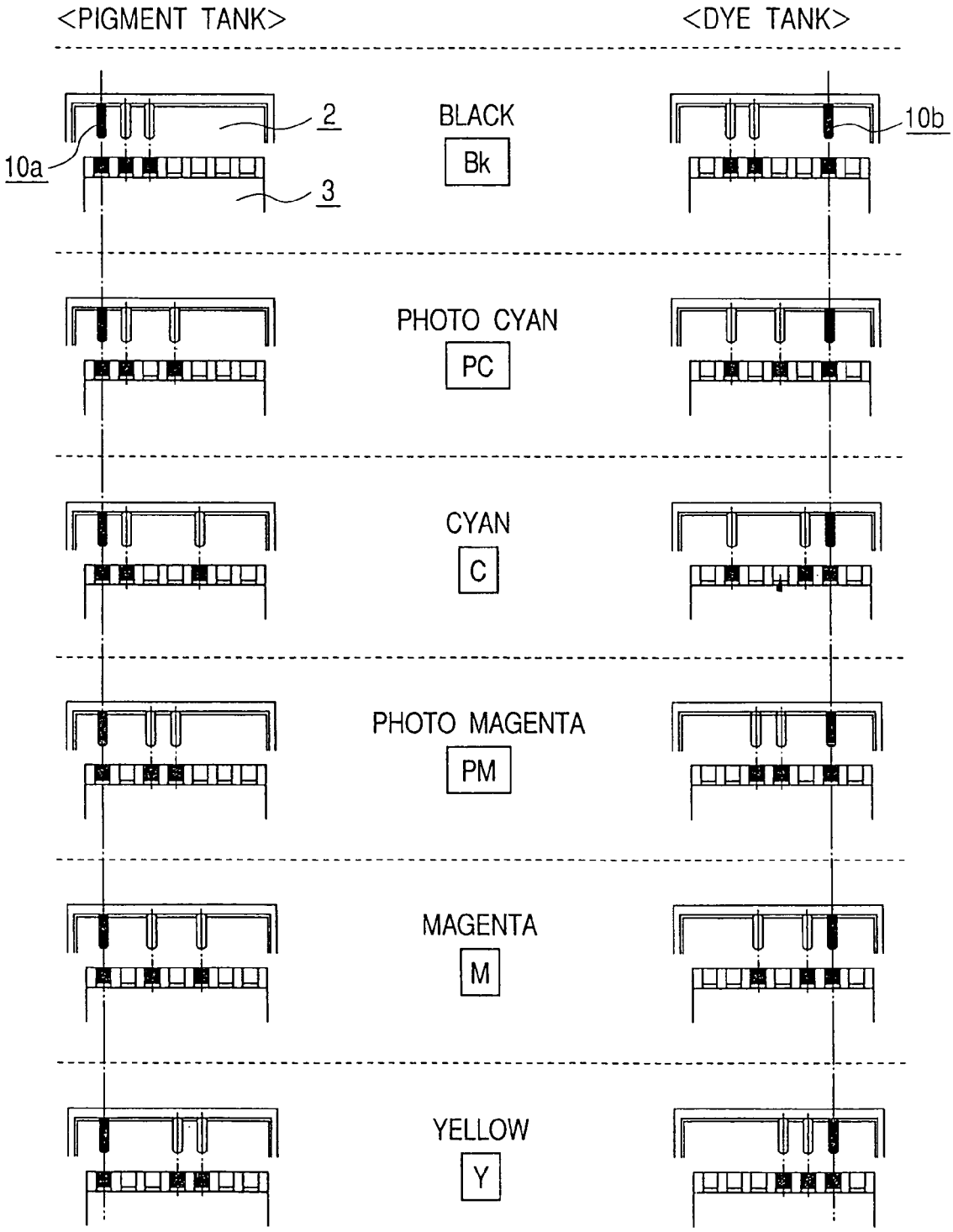
FIG. 3 is a schematic top view showing recessed/protruded portions for a dye and a pigment according to colors.

FIG. 3 is a top view showing configurations of the recessed/protruded portion 7 for the dye ink and the pigment ink according to every color classification as well as showing configurations, corresponding thereto, of protruded ribs of the ink tank holder 2. Among the seven pawls, the cut-away pawls are colored in solid black. Further, there are illustrated the configurations of the recessed/protruded portion 7 in such a color sequence as black, photo cyan, cyan, photo magenta, magenta and yellow from above. The left side shows configurations of the recessed/protruded portion 7 for the pigment ink, and the right side shows the configurations of the recessed/protruded portion 7 for the dye ink, respectively. Among the protruded ribs of the ink tank holder, the ribs colored in solid black represent specified dispositions of a rib 10*a* for the pigment ink and of a rib 10*b* for the dye ink.

As can be understood from this Figure, the recessed portion for distinction of the dye in the ink tank for the dye ink is in the same position throughout the respective colors, and exists in the second position from the right side among the seven pawls of the recessed/protruded portion 7. Further, the recessed portion for distinction of the pigment in the ink tank for the pigment ink is in the same position throughout the respective colors, and exists in the leftmost position among the seven pawls of the recessed/protruded portion 7. Moreover, the distinction between the dye ink and the pigment ink is made separately depending on cut-away dispositions of two pieces of pawls among the seven pawls of the recessed/protruded portion 7 of the ink tank, and, if the color is the same, the dispositions thereof are the same. According to this embodiment, in the ink tank for, e.g., the black ink, the cut-away pawls among the seven pawls of the recessed/protruded portion 7 are in the second and third positions from the left. These positions are the same irrespective of the ink tanks for the pigment and for the dye.

(Ink Tank Holder)

Figure 4:
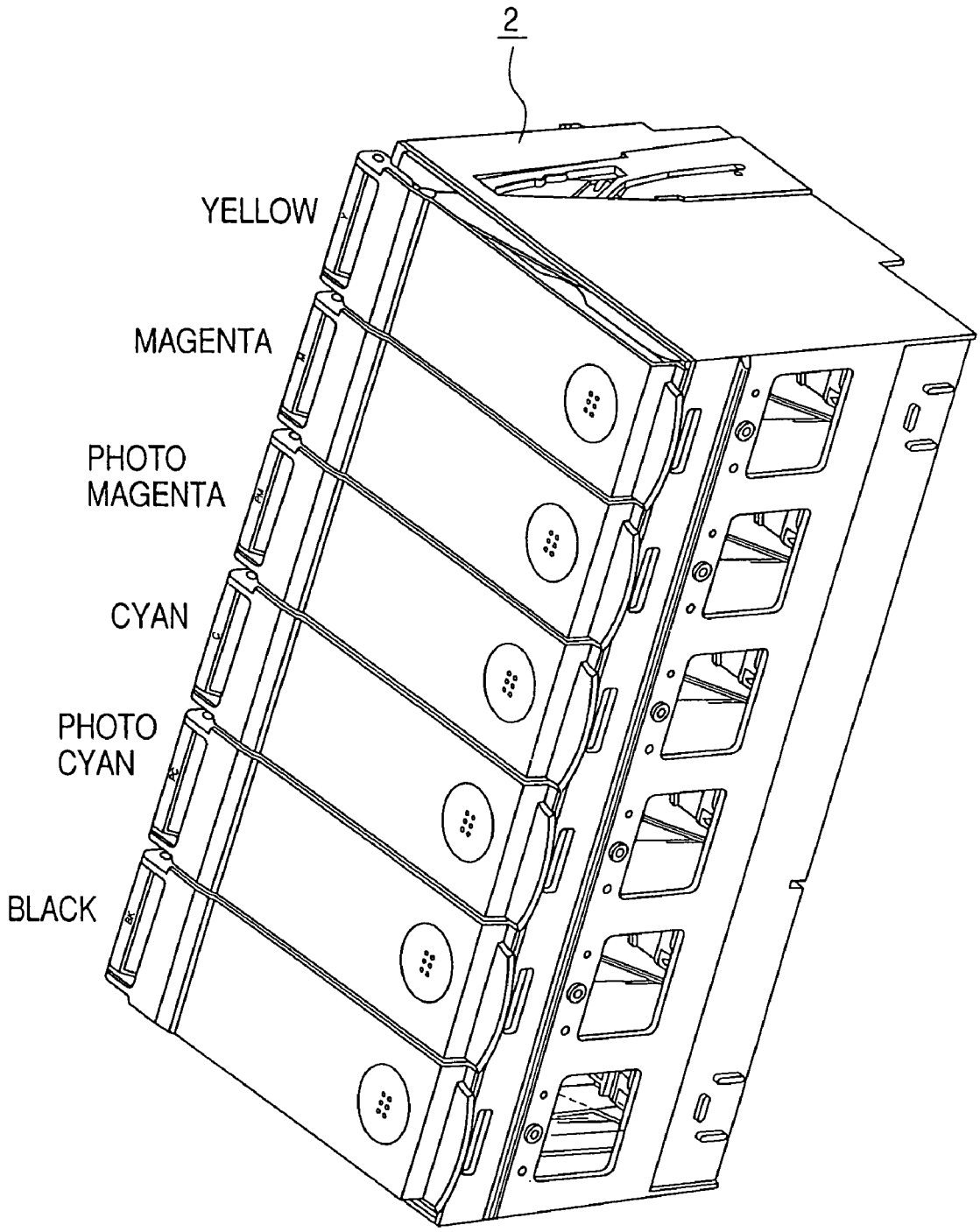
FIG. 4 is a perspective view of an ink tank holder.
Figure 5:
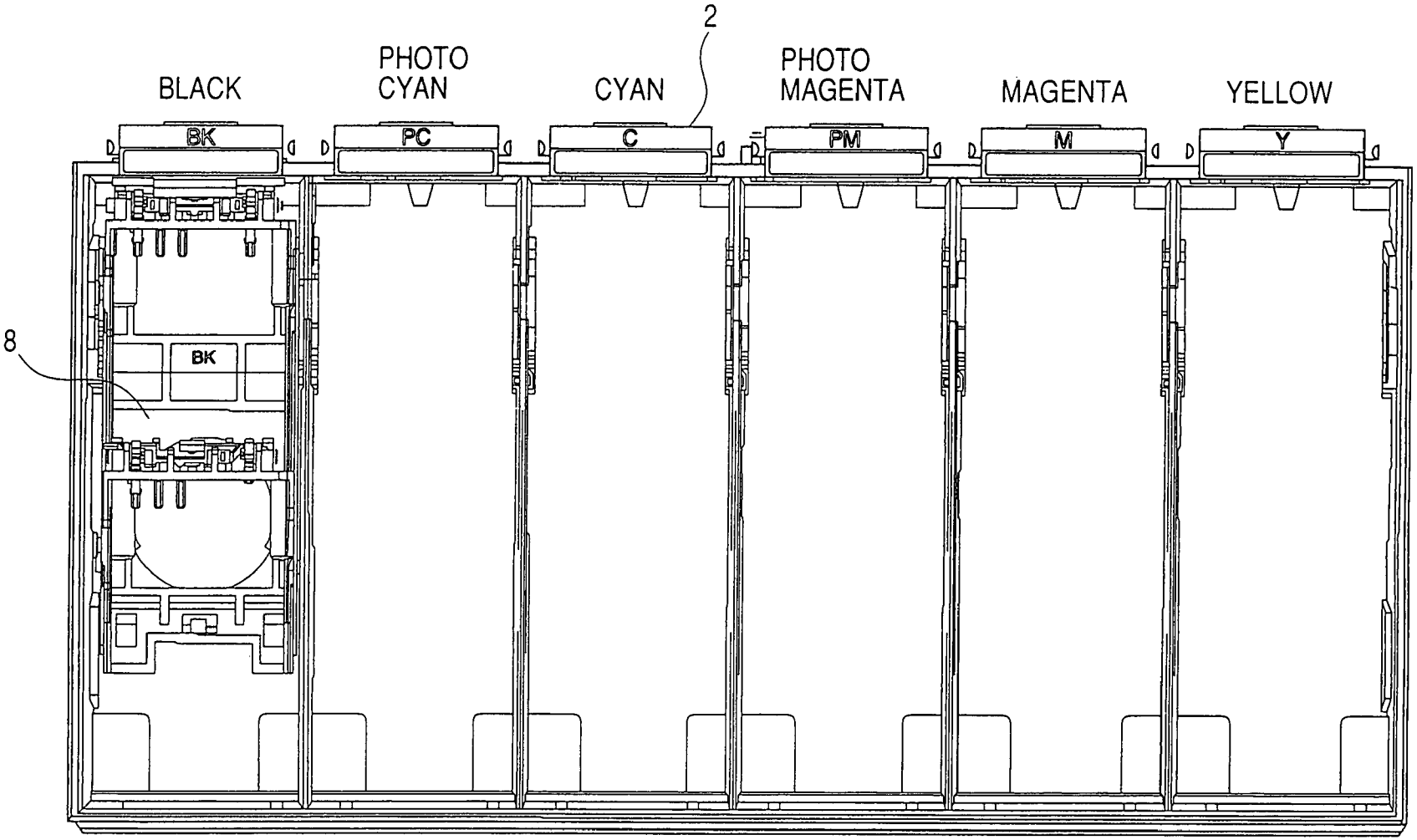
FIG. 5 is a top view of the ink tank holder.

FIG. 4 is a perspective view of the ink tank holder 2. FIG. 5 is a sectional view of the ink tank holder as viewed from above.

The ink jet recording apparatus in this embodiment is a 6-color recording apparatus, and takes a construction that a black (BK) tank, a photo cyan tank, a cyan tank, a photo magenta tank, a magenta tank and a yellow tank are loaded in sequence from the inner side in FIG. 4. FIG. 5 is a sectional view of the ink tank holder 2 in a state where the ink tanks 3 are not yet loaded. A construction of the ink tank holder 2 is that the ink tank holder 2 includes tank sockets 8 for loading the ink tanks 3 for the respective colors, and each of the tank sockets 8 is provided with the protruded ribs corresponding to the ink tank recessed/protruded portion 7. Referring to FIG. 5, only the tank socket 8 for black is illustrated.

Figure 6C:
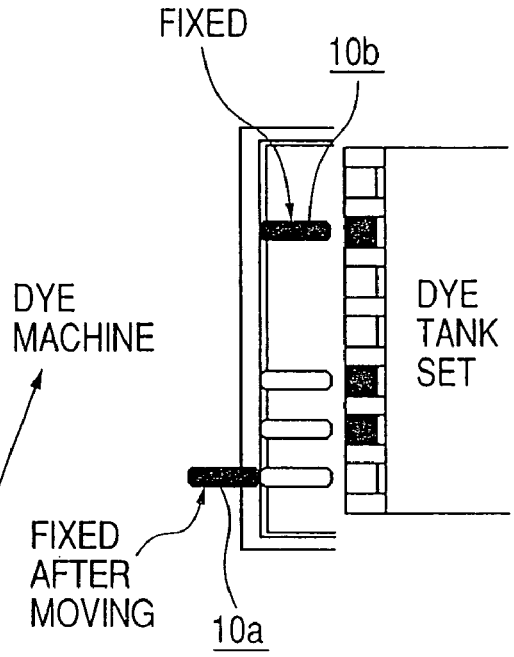
FIGS. 6A, 6B and 6C are explanatory views showing a relationship between a tank socket and ink tanks in the case of loading the ink tanks.
Figure 6A:
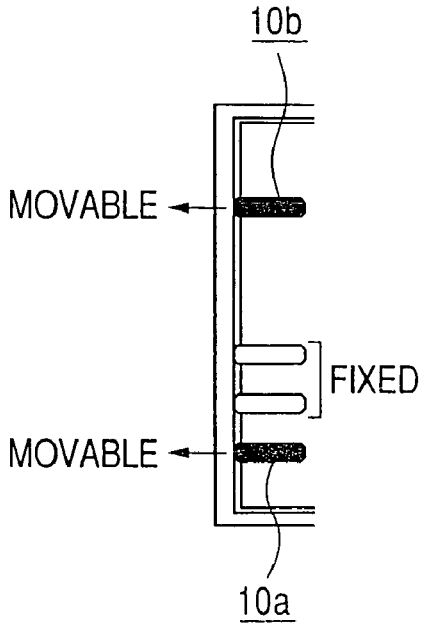
Figure 6B:
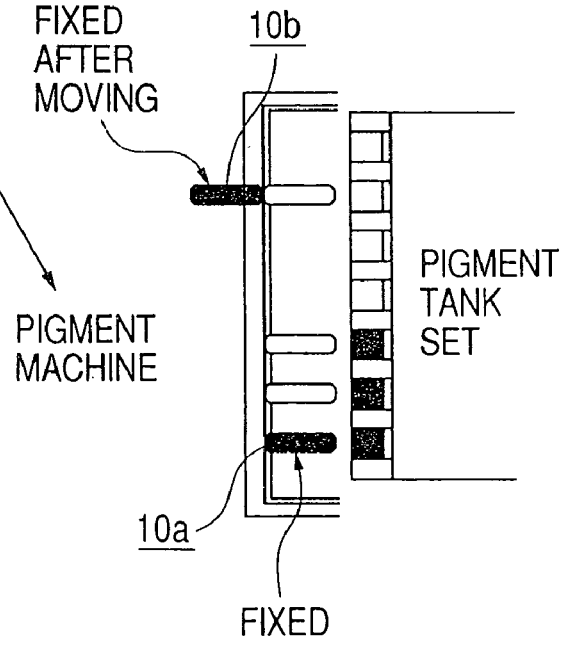

FIGS. 6A to 6C are schematic views explanatory of the construction of the ink tank holder of the present invention, showing a state of the protruded ribs of the tank socket in the ink tank loading unit for black. FIG. 6A shows a state of the protruded ribs in an initial state before loading the ink tank. FIG. 6B shows a state of the protruded ribs in the case of loading the pigment ink tank. FIG. 6C shows a state of the protruded ribs in the case of loading the dye ink tank.

As shown in FIGS. 6A to 6C, the initial state is a state where two pieces of ribs 10*a*, 10*b* for distinguishing between the dye and the pigment are protruded. In this state, the two pieces of ribs 10*a*, 10*b* are movable. When the ink tank is loaded, any one of the two movable type protruded ribs is pushed, whereby both of the two ribs, i.e., the pushed rib and the unpushed rib, are fixed. According to this embodiment, in the case of loading the pigment ink tank, the rib 10*a* corresponding to the leftmost recessed/protruded portion in the ink tank is fixed as it remains protruded, while the rib 10*b* corresponding to the second recessed/protruded portion from the right in the ink tank is moved by the ink tank and then fixed in a state of moving off the recessed/protruded portion in the ink tank. With this contrivance, only the loaded ink tank can be hereafter loaded in this tank socket. Namely, FIG. 6B shows a loading position set exclusively for the pigment ink tank, and FIG. 6C shows a loading position set exclusively for the dye ink tank. As described above, the distinction between the dye ink tank and the pigment ink tank is made by the specified ribs, while the ribs for distinguishing between the ink colors are set the same with the dye ink tank and the pigment ink tank, thereby making it possible to restrain a futile extension of the rib construction for the distinction and to simplify and downsize the configuration on the main body side.

Figure 7:
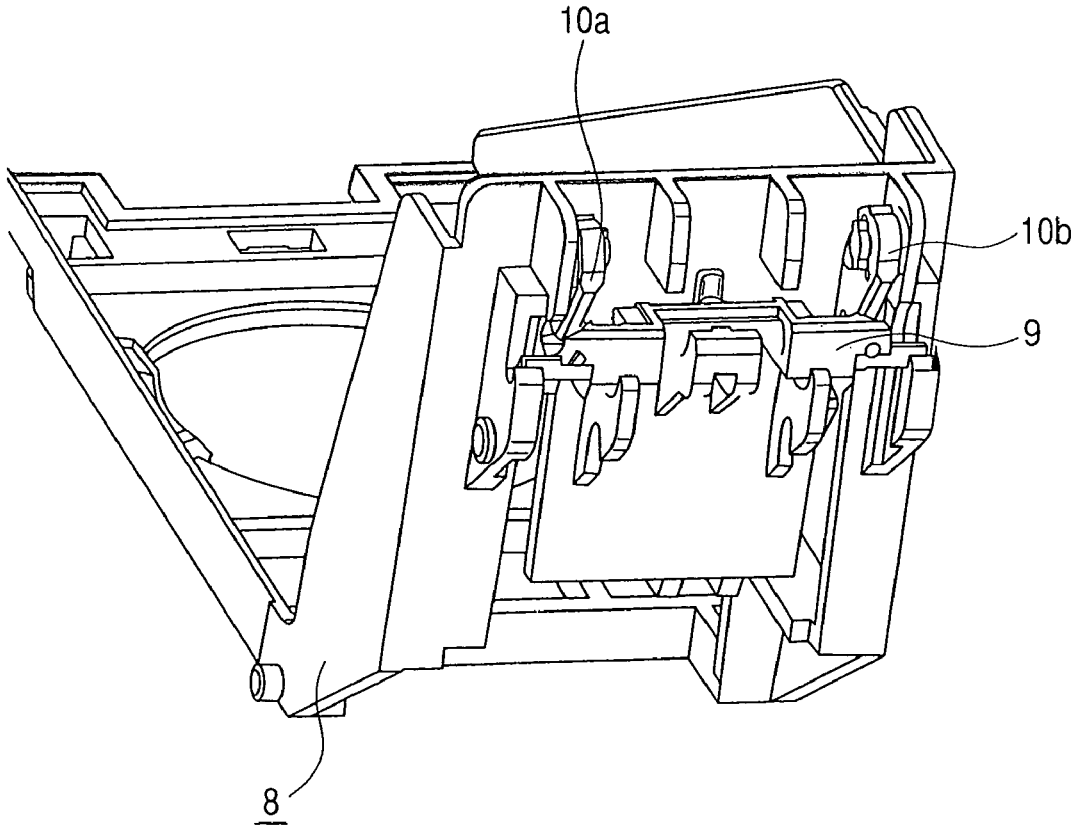
FIG. 7 is a perspective view showing a rear surface of the tank socket.
Figure 8A:
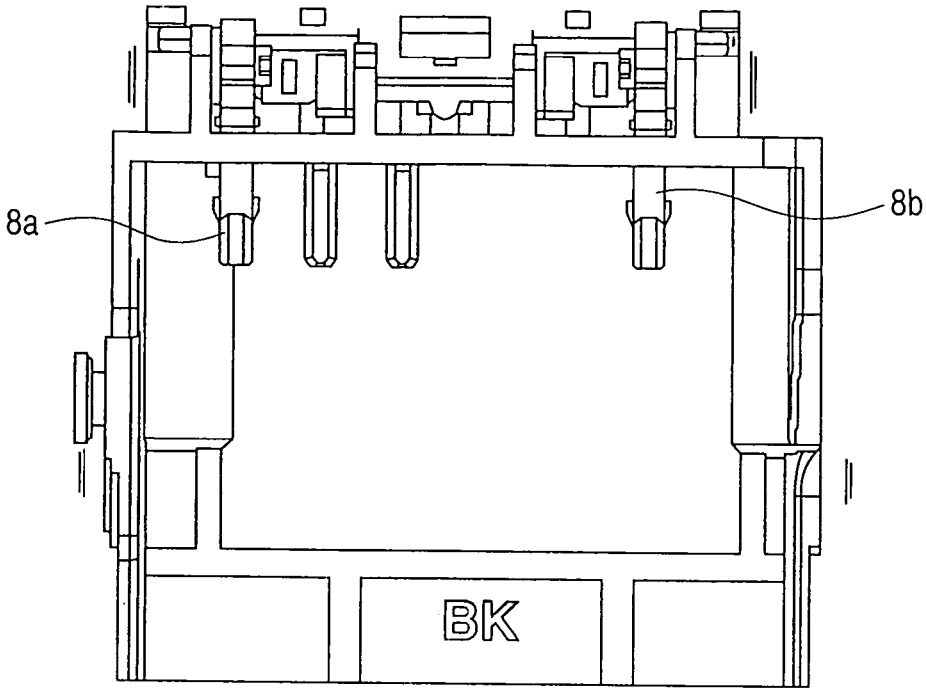
FIGS. 8A and 8B are top views.
Figure 8B:
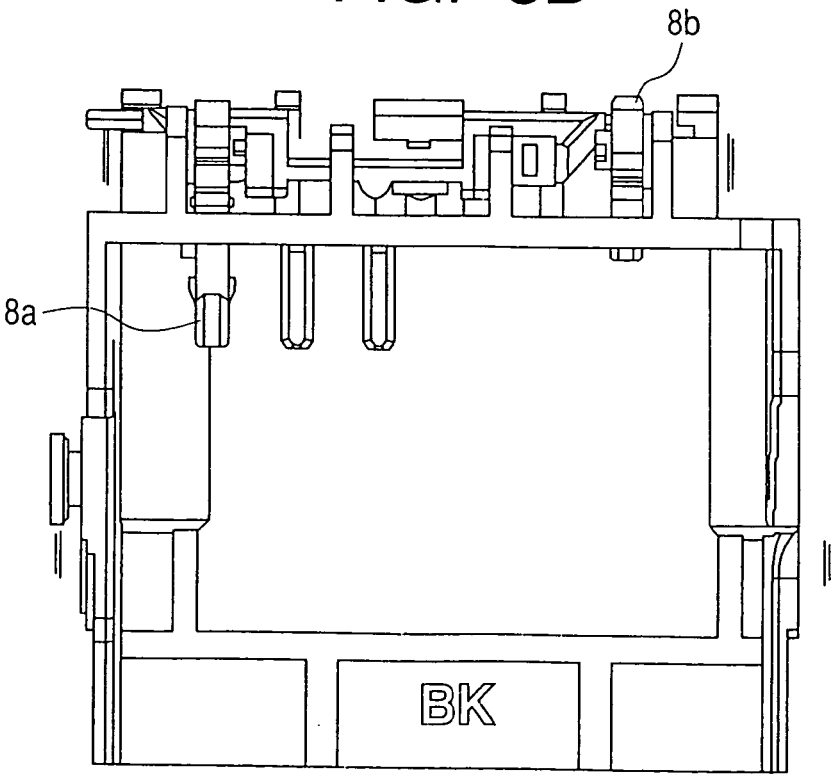

For describing the construction of the tank socket 8, FIG. 7 shows a perspective view of the tank socket 8 as viewed from the rear side in the initial state before loading the ink tank. Further, FIGS. 8A and 8B show a top view in the initial state, and FIG. 8B shows a top view in a state where the ink tank is unloaded after having loaded the pigment ink tank.

The tank socket 8 is constructed of two pieces of movable type protruded ribs 10*a* and 10*b* for distinguishing between the dye and the pigment, two pieces of fixed protruded ribs for distinguishing between the colors and a rib slider 9 linked to the movable ribs 10*a*, 10*b*. The rib slider 9 is provided with a protruded member so as to be movable only when pushed with a predetermined or larger force by the movable rib, this protruded member being engaged inside with a recessed portion of the tank socket 8. On the occasion of loading the ink tank, the predetermined or larger force is applied, the rib slider is structured to slide sideways to fix the movable type protruded rib that does not move. The movable type protruded rib that moves is structured to be fixed by the pawl extruding from the side of the tank socket.

According to the present invention, both of the movable type protruded ribs 10*a*, 10*b* for distinguishing between dye ink tank and the pigment ink tank are to be fixed after a user has loaded the ink tanks in the initial state. Depending on how, for example, a service man supports, even after the movable type protruded rib has been once fixed, the protruded rib that has moved is set to release the pawl and can be returned again to the initial state by moving the rib slider back to the initial position. The return to the original state enables the movable type protruded rib to be used for the dye ink and for the pigment ink. In the initial state, there is a possibility of mixing the dye ink and the pigment ink with each other, however, the inks become usable without any particular problems by performing a recovery operation when initially loading the ink tanks. Further, without being limited to how the service man supports, after recycling the recording apparatus, the movable type protruded ribs are set back to the initial positions in a factory, etc., the recycled recording apparatus becomes a recording apparatus in which the both of the dye ink and the pigment ink get similarly usable.

The present embodiment discussed so far has exemplified the tank socket for black. In the same way with other colors, the effects of the present invention can, however, be applied owing to the fixed type protruded ribs for distinguishing between the colors and the movable type protruded ribs for distinguishing between the dye ink tank and the pigment ink tank. Moreover, as for the category of the inks, only the distinctions between the dye ink and the pigment ink and between classifications of the ink colors have been explained, however, the present invention is not limited to this distinguishing mode and can be applied to recording apparatuses requiring a variety of distinctions.

What is claimed is:

1. An ink jet recording apparatus having a holder capable of mounting an ink tank, said holder capable of mounting a first ink tank for containing a first ink and a second ink tank for containing a second ink different from the first ink, said apparatus comprising:

a mounting inhibiting mechanism switched by mounting one of said first ink tank and said second ink tank and for inhibiting another ink tank which is different from the one of said first ink tank and said second ink tank which has been mounted from being mounted on said holder.

2. An ink jet recording apparatus according to claim 1, wherein said mounting inhibiting mechanism is a movable rib and said movable rib is fixed for an ink tank to be mounted later by mounting said first ink tank or said second ink tank.

3. An ink jet recording apparatus according to claim 2, wherein said movable rib includes a color discriminating rib and said color discriminating rib is fixed regardless of said ink tank which is first mounted.

* * * * *